US010337345B2

(12) United States Patent
Samudrala et al.

(10) Patent No.: US 10,337,345 B2
(45) Date of Patent: Jul. 2, 2019

(54) BUCKET MOUNTED MULTI-STAGE TURBINE INTERSTAGE SEAL AND METHOD OF ASSEMBLY

(71) Applicant: General Electric Company, Schenectady, NY (US)

(72) Inventors: Omprakash Samudrala, Clifton Park, NY (US); Fernando Jorge Casanova, Simpsonville, SC (US); Edip Sevincer, Watervliet, NY (US); Jonathan Michael Webster, Travelers Rest, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 822 days.

(21) Appl. No.: 14/627,431

(22) Filed: Feb. 20, 2015

(65) Prior Publication Data

US 2016/0245106 A1 Aug. 25, 2016

(51) Int. Cl.
*F01D 11/00* (2006.01)
*F01D 5/06* (2006.01)
(Continued)

(52) U.S. Cl.
CPC ..... *F01D 11/006* (2013.01); *F01D 5/06* (2013.01); *F01D 5/12* (2013.01); *F01D 5/3007* (2013.01);
(Continued)

(58) Field of Classification Search
CPC ..... F01D 11/06; F01D 5/06; F01D 5/12
See application file for complete search history.

(56) References Cited

U.S. PATENT DOCUMENTS 2,656,147 A 10/1953 Brownhill et al.
3,094,309 A 6/1963 Hall, Jr. et al.
(Continued)

FOREIGN PATENT DOCUMENTS

CH 703 590 A2 2/2012
CN 101818661 A 9/2010
(Continued)

OTHER PUBLICATIONS

Extended European Search Report and Opinion issued in connection with corresponding EP Application No. 16156255.8 dated Sep. 29, 2016.
(Continued)

*Primary Examiner* — Kayla McCaffrey
(74) *Attorney, Agent, or Firm* — GE Global Patent Operation; John Darling

(57) ABSTRACT

A sealing system for a multi-stage turbine includes multiple interstage seal segments disposed circumferentially about a turbine rotor wheel assembly and extending axially between a forward turbine stage and an aft turbine stage. Each of the interstage seal segments includes a forward end portion including an outer seal surface and an inner support face, an aft end portion, including an outer seal surface and an inner support face and a main body portion extending axially from the forward end portion to the aft end. The main body portion includes at least two support webs coupling the outer seal surfaces and the inner support faces. The outer seal surfaces are configured to be retained in a radial direction by a land support on each of a forward and aft stage turbine buckets, such that substantially all the centrifugal load from the multiple interstage seal segments is transferred to the forward and aft stage turbine buckets. A method of assembling the sealing system is disclosed.

7 Claims, 18 Drawing Sheets

(51) Int. Cl.
*F01D 5/30* (2006.01)
*F01D 5/12* (2006.01)
*F01D 11/02* (2006.01)

(52) U.S. Cl.
CPC ..... *F01D 11/001* (2013.01); *F01D 11/005* (2013.01); *F01D 11/02* (2013.01); *F05D 2220/30* (2013.01); *F05D 2230/60* (2013.01); *F05D 2240/24* (2013.01); *F05D 2240/55* (2013.01); *F05D 2260/97* (2013.01)

(56) References Cited

U.S. PATENT DOCUMENTS

| | | | | |
|---|---|---|---|---|
| 3,295,825 | A | 1/1967 | Hall, Jr. | |
| 3,533,711 | A | 10/1970 | Kercher | |
| 3,647,311 | A | 3/1972 | Wootton et al. | |
| 3,733,146 | A | 5/1973 | Smith et al. | |
| 4,094,673 | A | 6/1978 | Erickson et al. | |
| 4,127,359 | A | 11/1978 | Stephan | |
| 4,309,147 | A | 1/1982 | Koster et al. | |
| 4,332,133 | A | 6/1982 | Schwarz et al. | |
| 4,470,757 | A | 9/1984 | Vollinger | |
| 4,645,424 | A | 2/1987 | Peters | |
| 4,655,683 | A | 4/1987 | Chaplin | |
| 4,659,289 | A | 4/1987 | Kalogeros | |
| 4,669,959 | A | 6/1987 | Kalogeros | |
| 4,869,640 | A | 9/1989 | Schwarz et al. | |
| 4,884,950 | A | 12/1989 | Brodell et al. | |
| 5,054,996 | A | 10/1991 | Carreno | |
| 5,157,914 | A | 10/1992 | Schwarz et al. | |
| 5,211,407 | A | 5/1993 | Glynn et al. | |
| 5,236,302 | A * | 8/1993 | Weisgerber | F01D 5/06 415/173.7 |
| 5,338,154 | A | 8/1994 | Meade et al. | |
| 5,339,619 | A | 8/1994 | Antonellis | |
| 5,358,374 | A | 10/1994 | Antonellis | |
| 5,758,487 | A | 6/1998 | Salt et al. | |
| 5,833,244 | A | 11/1998 | Salt et al. | |
| 5,967,745 | A | 10/1999 | Tomita et al. | |
| 6,152,685 | A | 11/2000 | Hagi | |
| 6,152,690 | A | 11/2000 | Tomita et al. | |
| 6,189,891 | B1 | 2/2001 | Tomita et al. | |
| 6,190,131 | B1 | 2/2001 | Deallenbach | |
| 6,217,279 | B1 | 4/2001 | Ai et al. | |
| 6,506,016 | B1 | 1/2003 | Wang | |
| 6,554,570 | B2 | 4/2003 | Dailey | |
| 6,655,920 | B2 | 12/2003 | Beutin et al. | |
| 6,899,520 | B2 | 5/2005 | Habedank et al. | |
| 7,052,240 | B2 | 5/2006 | Race et al. | |
| 7,059,829 | B2 | 6/2006 | Garner | |
| 7,220,099 | B2 | 5/2007 | Bekrenev et al. | |
| 7,334,983 | B2 | 2/2008 | Alvanos et al. | |
| 7,371,044 | B2 | 5/2008 | Nereim | |
| 7,470,113 | B2 | 12/2008 | Tran et al. | |
| 7,520,718 | B2 * | 4/2009 | Engle | F01D 5/3015 415/173.7 |
| 7,722,319 | B2 | 5/2010 | Staempfli et al. | |
| 8,162,598 | B2 | 4/2012 | Liang | |
| 8,177,495 | B2 | 5/2012 | Bowes et al. | |
| 8,235,656 | B2 * | 8/2012 | Wilson | F01D 11/001 415/173.7 |
| 8,348,603 | B2 | 1/2013 | Garcia-Crespo et al. | |
| 8,511,976 | B2 | 8/2013 | Cummins et al. | |
| 8,827,643 | B2 | 9/2014 | Ingram | |
| 8,834,122 | B2 | 9/2014 | Ingram | |
| 2003/0082049 | A1 | 5/2003 | Brisson et al. | |
| 2007/0014668 | A1 | 1/2007 | Engle | |
| 2007/0059158 | A1 | 3/2007 | Alvanos et al. | |
| 2008/0008582 | A1 | 1/2008 | Pickens et al. | |
| 2008/0044284 | A1 | 2/2008 | Alvanos | |
| 2010/0074731 | A1 | 3/2010 | Wiebe et al. | |
| 2010/0074732 | A1 | 3/2010 | Marra et al. | |
| 2010/0178160 | A1 | 7/2010 | Liotta et al. | |
| 2011/0255958 | A1 | 10/2011 | Farrell | |
| 2012/0003079 | A1 | 1/2012 | Farrell et al. | |
| 2012/0171022 | A1 | 7/2012 | Hafner | |
| 2013/0028708 | A1 | 1/2013 | Jayana | |
| 2013/0028743 | A1 | 1/2013 | Babu et al. | |
| 2013/0236289 | A1 * | 9/2013 | Liotta | F01D 11/001 415/1 |
| 2013/0259700 | A1 | 10/2013 | Piersall et al. | |
| 2015/0010393 | A1 | 1/2015 | Hafner | |

FOREIGN PATENT DOCUMENTS

| | | | |
|---|---|---|---|
| CN | 101858257 | A | 10/2010 |
| EP | 2 535 523 | A2 | 12/2012 |
| WO | 2014/100316 | A1 | 6/2014 |

OTHER PUBLICATIONS

Non-Final Rejection towards U.S. Appl. No. 13/418,281 dated Sep. 4, 2015.

Unofficial English Translation of First Office Action and Search issued in connection with related CN Application No. 201310078297.9 dated Aug. 5, 2015 (English Translation).

Final Rejection towards U.S. Appl. No. 13/418,281 dated Apr. 21, 2016.

Advisory Action towards U.S. Appl. No. 13/418,281 dated Jul. 19, 2016.

Unofficial English Translation of Search Report issued in connection with related JP Application No. 2013-042476 dated Nov. 28, 2016 (English Translation).

Unofficial English Translation of Notification of Reason for Refusal issued in connection with related JP Application No. 2013-042476 dated Dec. 6, 2016 (English Translation).

Lawrence et al., "Gas Path Sealing in Turbine Engines", ASLE Transactions, pp. 1-22, vol. 23, Issue 1, Mar. 25, 2008.

U.S. Appl. No. 13/418,281, filed Mar. 12, 2012, Liotta et al.

* cited by examiner

BUCKET MOUNTED MULTI-STAGE TURBINE INTERSTAGE SEAL AND METHOD OF ASSEMBLY

BACKGROUND

The present application relates generally to multi-stage turbines and more particularly relates to interstage seals within multi-stage turbines.

In general, turbine engines combust a mixture of compressed air and fuel to produce hot combustion gases. The combustion gases may flow through one or more turbine stages to generate power for a load and/or compressor. A pressure drop may occur between stages, which may allow leakage flow of a fluid, such as combustion gases, through unintended paths. It is desirable to confine the combustion gases within a defined annular flow path to shield certain rotor parts and to maximize power extraction. Moreover, turbine rotor wheels which support the buckets (blades) are subjected to significant thermal loads during their operating life and thus need to be cooled. Therefore, seals, for example, mechanical seals may be disposed between the stages to reduce fluid leakage between the stages and also prevent the turbine rotor wheels from direct exposure to hot gases. Unfortunately, the seals may not be field maintainable, or a substantial amount of work may be required to replace the seals in the field. In addition, the shape of the seals may make access to internal components of the turbine more difficult. Furthermore, the seals may require additional components, such as spacer wheels between two turbine rotor wheels to ensure proper axial and radial alignment of the seals. Static seals may also be used that require axial extensions from the two turbine rotor wheels which meet in the middle to accommodate the static seal. However, this does not isolate turbine rotor wheels from the hot gas path, thereby necessitating higher performance alloys for rotor parts at high cost for withstanding the harsh temperatures in the event of hot gas ingestion. In addition, the static seals cannot be applied to flange bolted rotor architectures, where access to wheel flange bolts is required during assembly/disassembly.

There is therefore a desire for improved interstage sealing systems for multi-stage turbines. Such sealing assemblies should improve overall system efficiency while being inexpensive to assemble, fabricate and providing an increased life for the associated parts.

BRIEF DESCRIPTION

In accordance with one or more embodiments shown or described herein, a sealing component for reducing secondary airflow in a turbine system is disclosed. The sealing component includes a forward end portion, an aft end portion and a main body portion. The forward end portion including an outer seal surface and an inner support face, wherein the outer seal surface is configured to be retained in a radial direction by a support land on a forward stage turbine bucket. The aft end portion including an outer seal surface and an inner support face, wherein the outer seal surface is configured to be retained in a radial direction by a support land on an aft stage turbine bucket. The main body portion extending axially from the forward end portion to the aft end portion, the main body portion comprising at least two support webs coupling the outer seal surface and the inner support face of the forward end portion to the outer seal surface and the inner support face of the aft end portion. The sealing component configured to provide for substantially all the centrifugal load from the sealing component to be transferred to the forward stage turbine bucket and the aft stage turbine bucket.

In accordance with one or more embodiments shown or described herein, a sealing system for a multi-stage turbine is disclosed. The sealing system includes an interstage seal disposed circumferentially about a turbine rotor wheel assembly of the multi-stage turbine and extending axially between a forward turbine stage and an aft turbine stage of the multi-stage turbine. The interstage seal including a plurality of near flow path seal segments. Each of the plurality of near flow path seal segments including an outer seal surface and inner support faces extending from at least one downstream region of the forward turbine stage to at least one upstream region of the aft turbine stage such that substantially all the centrifugal load from the interstage seal is transferred to a plurality of forward stage buckets and a plurality of aft stage buckets. The interstage seal further including at least two support webs coupling the outer seal surfaces and the inner support faces. Each of the plurality of near flow path seal segments extends from an angel wing region of the plurality of forward stage buckets to an angel wing region of the plurality of aft stage buckets.

In accordance with one or more embodiments shown or described herein, a method of assembling a sealing system of a multi-stage turbine having a plurality of forward buckets and a plurality of aft buckets on a forward turbine rotor wheel and an aft turbine rotor wheel is disclosed. The method of assembling the sealing system includes installing each of the plurality of aft stage buckets onto each of a plurality of dovetail slots of the aft stage turbine rotor wheel; engaging an outer seal surface at an aft end of each of a plurality of interstage seal segments with an angel wing region of each of the plurality of aft stage buckets and engaging an inner support face at an aft end of each of the plurality of interstage seal segments with one of the angel wing region of each of the plurality of aft stage buckets, a dovetail region of the plurality of aft stage buckets or the aft stage turbine rotor wheel, by moving each of the plurality of interstage seal segments radially inward and axially such that the outer seal surface is fully engaged with the angel wing region of each of the plurality of aft stage buckets and the inner support face is fully engaged with one of the angel wing region of each of the plurality of aft stage buckets, the dovetail region of the plurality of aft stage buckets or the aft stage turbine rotor wheel. The method further including installing each of the plurality of forward stage buckets onto each of a plurality of dovetail slots of the forward stage turbine rotor wheel such that an outer seal surface at a forward end of each of the plurality of interstage seal segments is fully engaged with an angel wing region of each of the plurality of forward stage buckets and an inner support face at the forward end of each of the plurality of interstage seal segments is fully engaged with with one of the angel wing region of each of the plurality of forward stage buckets, a dovetail region of the plurality of forward stage buckets or the forward stage turbine rotor wheel, to retain each of the plurality of interstage seal segments in a radial direction such that substantially all the centrifugal load from the interstage seal is transferred to the plurality of forward stage buckets and the plurality of aft stage buckets.

DRAWINGS

These and other features, aspects, and advantages of the present disclosure will become better understood when the following detailed description is read with reference to the accompanying drawings in which like characters represent like parts throughout the drawings, wherein.

and

Figure 24:
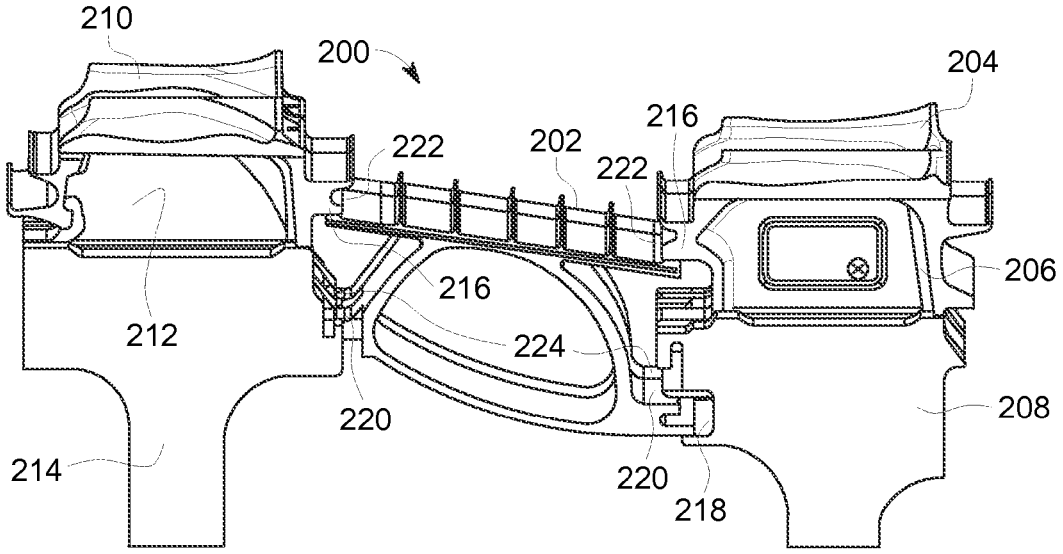
Figure 25:
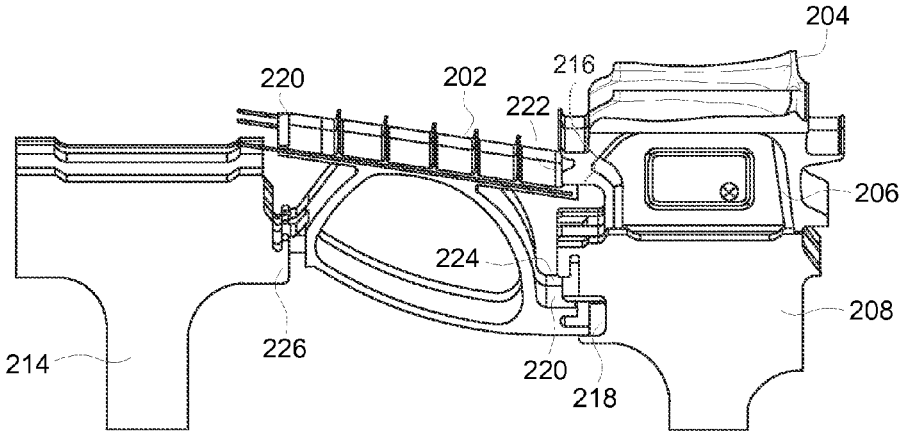
Figure 26:
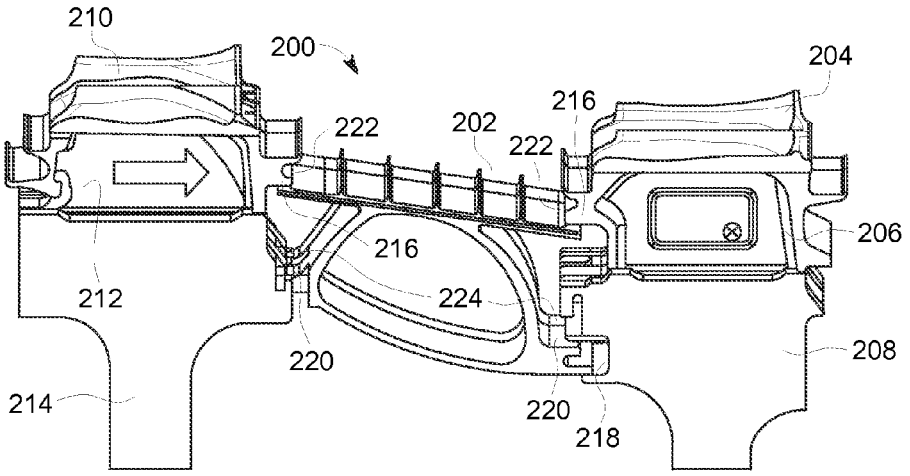
Figure 27:
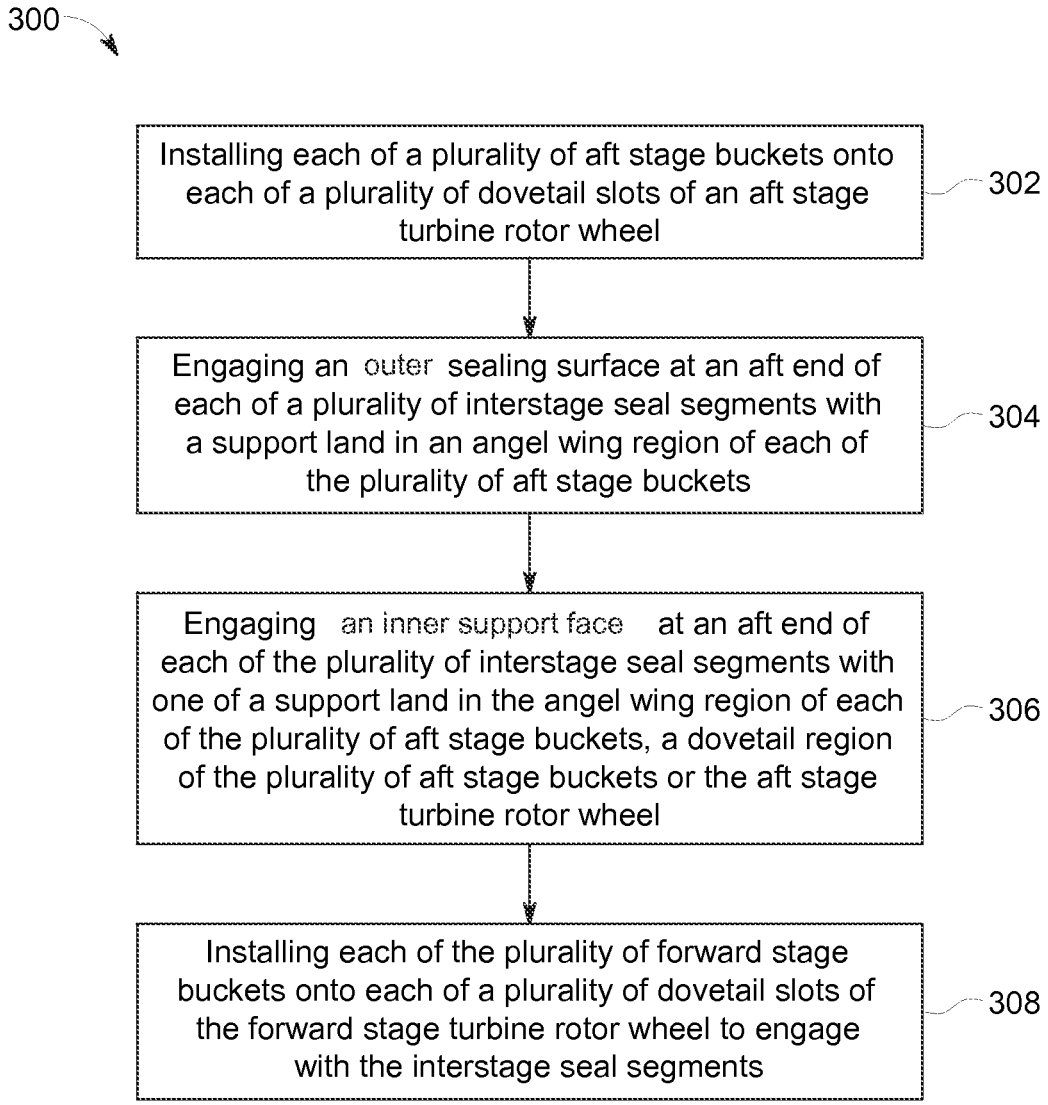

FIG. 24 is a partial perspective view of an alternate embodiment of an interstage sealing system of a multi-stage turbine, in accordance with one or more embodiments shown or described herein;

FIG. 25 is a partial perspective view illustrating a step in a method of assembling the interstage sealing system of FIG. 24, in accordance with one or more embodiments shown or described herein;

FIG. 26 is a partial perspective view illustrating a step in a method of assembling the interstage sealing system of FIG. 24, in accordance with one or more embodiments shown or described herein; and FIG. 27 is flow chart illustrating steps involved in a method of assembling an interstage sealing system of a multi-stage turbine, in accordance with one or more embodiments shown or described herein.

DETAILED DESCRIPTION

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments. Furthermore, as used herein, an "axial" direction is a direction parallel to the central axis, and a "radial" direction is a direction extending from the central axis and perpendicular to the central axis. An "outer" location refers to a location in the radial direction that is farther away from the central axis than an "inner" location.

Figure 1:
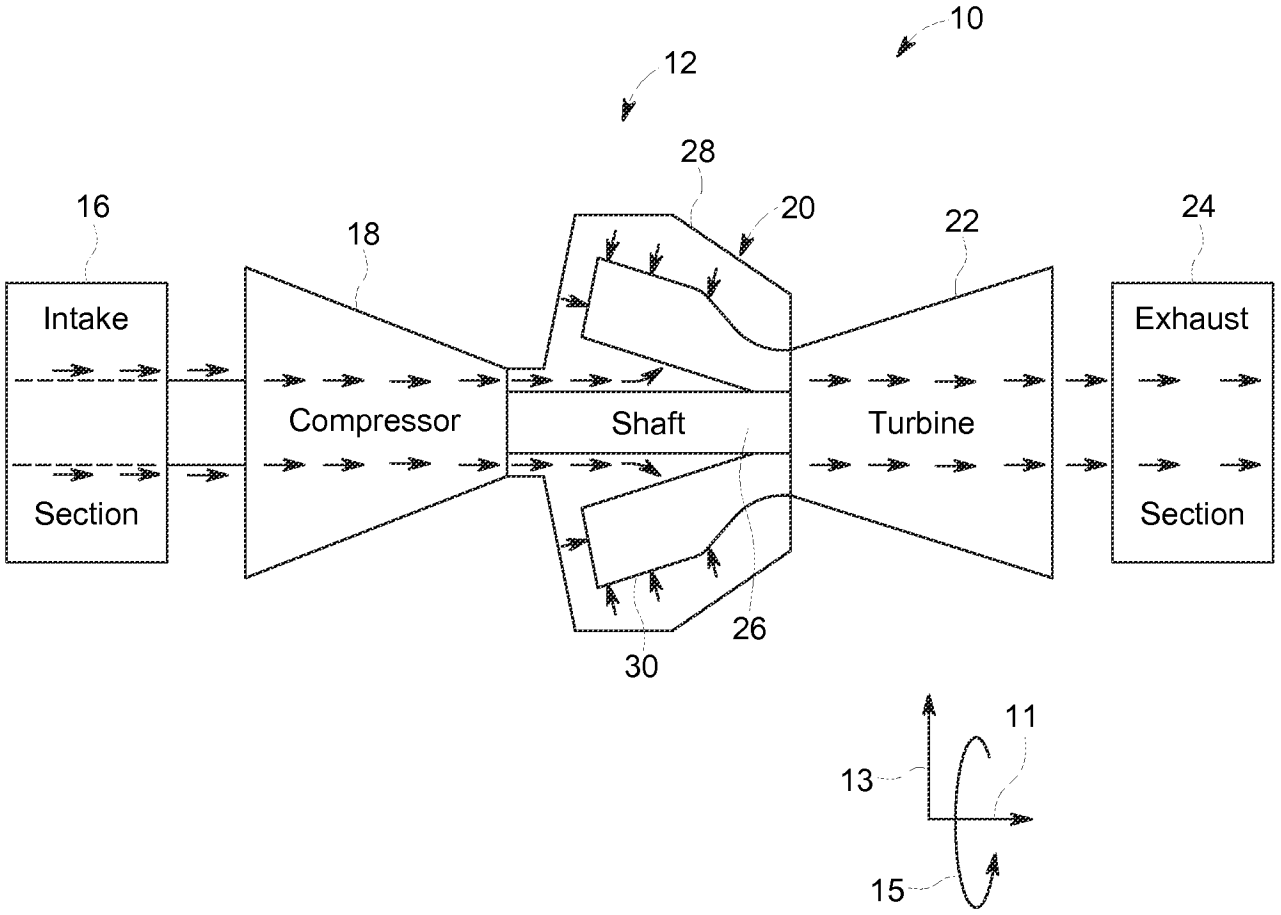
FIG. 1 is a schematic flow diagram of a multi-stage turbine engine that may employ turbine seals, in accordance with one or more embodiments shown or described herein.

FIG. 1 is a block diagram of an exemplary system 10 including a multi-stage turbine engine 12 that may employ interstage seals as described in detail below. In certain embodiments, the system 10 may include an aircraft, a watercraft, a locomotive, a power generation system, or combinations thereof. The illustrated multi-stage turbine engine 12 includes an air intake section 16, a compressor 18, a combustor section 20, a turbine 22, and an exhaust section 24. The turbine 22 is coupled to the compressor 18 via a turbine rotor wheel shaft 26.

As indicated by the arrows, air may enter the multi-stage turbine engine 12 through the intake section 16 and flow into the compressor 18, which compresses the air prior to entry into the combustor section 20. The illustrated combustor section 20 includes a combustor housing 28 disposed concentrically or annularly about the turbine rotor wheel shaft 26 between the compressor 18 and the turbine 22. The compressed air from the compressor 18 enters one or more combustors 30, where the compressed air may mix and combust with fuel within the one or more combustors 30 to drive the turbine 22. From the combustor section 20, the hot combustion gases flow through the turbine 22, driving the compressor 18 via the turbine rotor wheel shaft 26. For example, the combustion gases may apply motive forces to the turbine rotor blades within the turbine 22 to rotate the turbine rotor wheel shaft 26. After flowing through the turbine 22, the hot combustion gases may exit the multi-stage turbine engine 12 through the exhaust section 24. As discussed below, the turbine 22 may include a plurality of interstage sealing systems, which may reduce the leakage of hot combustion gasses between stages of the turbine 22, and also reduce the leakage of cooling/purge air between rotating components of the turbine 22, such as turbine rotor wheels. Throughout the discussion presented herein, a set of axes will be referenced. These axes are based on a cylindrical coordinate system and point in an axial direction 11 (e.g. longitudinal), a radial direction 13, and a circumferential direction 15. Further, the terms "first" and "second" may be applied to elements of the system 10 to distinguish between repeated instances of an element. These terms are not intended to impose a serial or temporal limitation to the corresponding elements.

Figure 2:
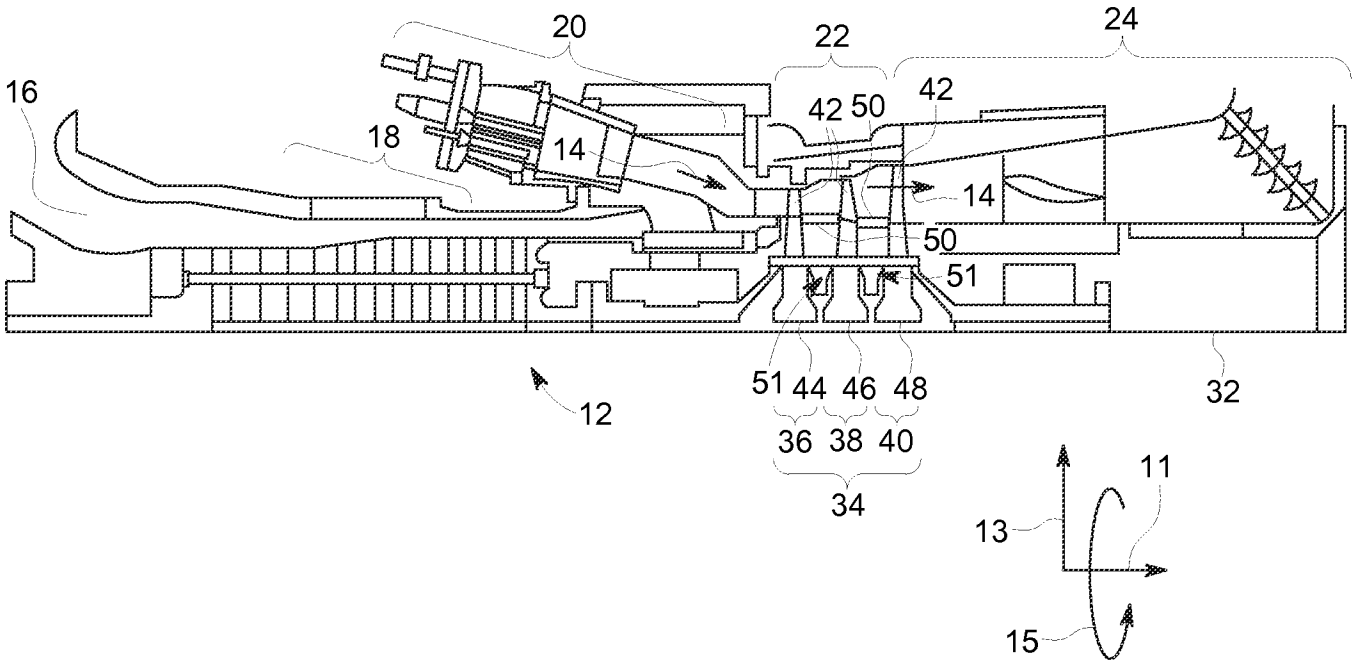
FIG. 2 is a cross-sectional side view of a multi-stage turbine engine taken along a longitudinal axis, in accordance with one or more embodiments shown or described herein.

FIG. 2 is a cross-sectional side view of an embodiment of the multi-stage turbine engine 12 of FIG. 1 taken along a longitudinal axis 32. As depicted, the multi-stage turbine 22 includes three separate stages 34; however, the multi-stage turbine 22 may include any number of stages 34. The turbine stages 34 include a first turbine stage 36, an aft turbine stage 38 and a third turbine stage 40. Each stage 34 includes a set of buckets, interchangeably referred to herein as blades, 42 coupled to an outer periphery of a turbine rotor wheel that may be rotatably attached to the turbine rotor wheel shaft 26 (FIG. 1). Specifically, the first turbine stage 36 includes a first turbine rotor wheel 44, the aft turbine stage 38 includes an aft turbine rotor wheel 46 and the third turbine stage 40 includes a third turbine rotor wheel 48. For illustration purposes, a single turbine bucket 42 for each stage is illustrated. The set of buckets 42 extend radially outward from each of the turbine rotor wheels 44, 46, 48 and are partially disposed within the path of the hot combustion gases through the turbine 22. The buckets 42 are attached by any suitable mechanism, such as an axially extending dovetail connection (described presently). In an embodiment, the buckets 42 each include a platform/shank portion (described presently) configured to attach to the corresponding turbine rotor wheel.

As described in greater detail below, an interstage sealing system 50 may extend between each of the stages 34 and supported by adjacent buckets of the set of buckets 42 to reduce heated gas or air from leaking into interstage volumes 51 and away from a flow path 14 (as shown in FIG. 2) defined by the buckets 42. The interstage sealing system 50 is disposed in a fixed position relative to the rotating rotor wheels 44, 46, 48 and therefore rotates along with the rotor wheels. As described in detail below, the interstage sealing system 50 causes a sealing connection between two adjacent stages of the buckets 42.

In the illustrated embodiment, a single interstage sealing system 50 is disposed between the first turbine stage, also referred to herein as a forward turbine stage, 36 and the second turbine stage, also referred to herein as an aft turbine stage, 38. Each of the interstage sealing systems 50 may include multiple axial interstage seal segments (described presently) that wedge against each other circumferentially about the turbine rotor wheel shaft (shown as turbine rotor wheel shaft 26 in FIG. 1) of the multi-stage turbine (shown as 12 in FIG. 1). Accordingly, each of the interstage sealing systems 50 may be designed to be field maintainable and field replaceable. In addition, the interstage sealing systems 50 may provide for improved cooling of the stages 34. Although the multi-stage turbine 22 is illustrated in FIG. 2 as a three-stage turbine, the interstage sealing systems 50 described herein may be employed in any suitable type of turbine with any number of stages and shafts. For example, the interstage sealing systems 50 may be included in a single turbine system, in a dual turbine system that includes a low-pressure turbine and a high-pressure turbine, or in a steam turbine. Further, the interstage sealing systems 50 described herein may also be employed in a rotary compressor, such as the compressor 18 illustrated in FIG. 1. The interstage sealing systems 50 may be made from various high-temperature alloys, such as, but not limited to, nickel based alloys.

In certain embodiments, an interstage volume 51 is defined between the turbine rotor wheels 44, 46, 48 and may be cooled by discharge air bled from the compressor 18 or provided by another source. However, flow of hot combustion gases into the interstage volumes 51 may abate the cooling effects. Accordingly, the interstage sealing systems 50 may be disposed between adjacent buckets 42 to seal and enclose the interstage volumes 51 from the hot combustion gases. In addition, the interstage sealing systems 50 may be configured to direct a cooling fluid to the interstage volumes 51 or from the interstage volumes 51 toward the buckets 42.

Figure 3:
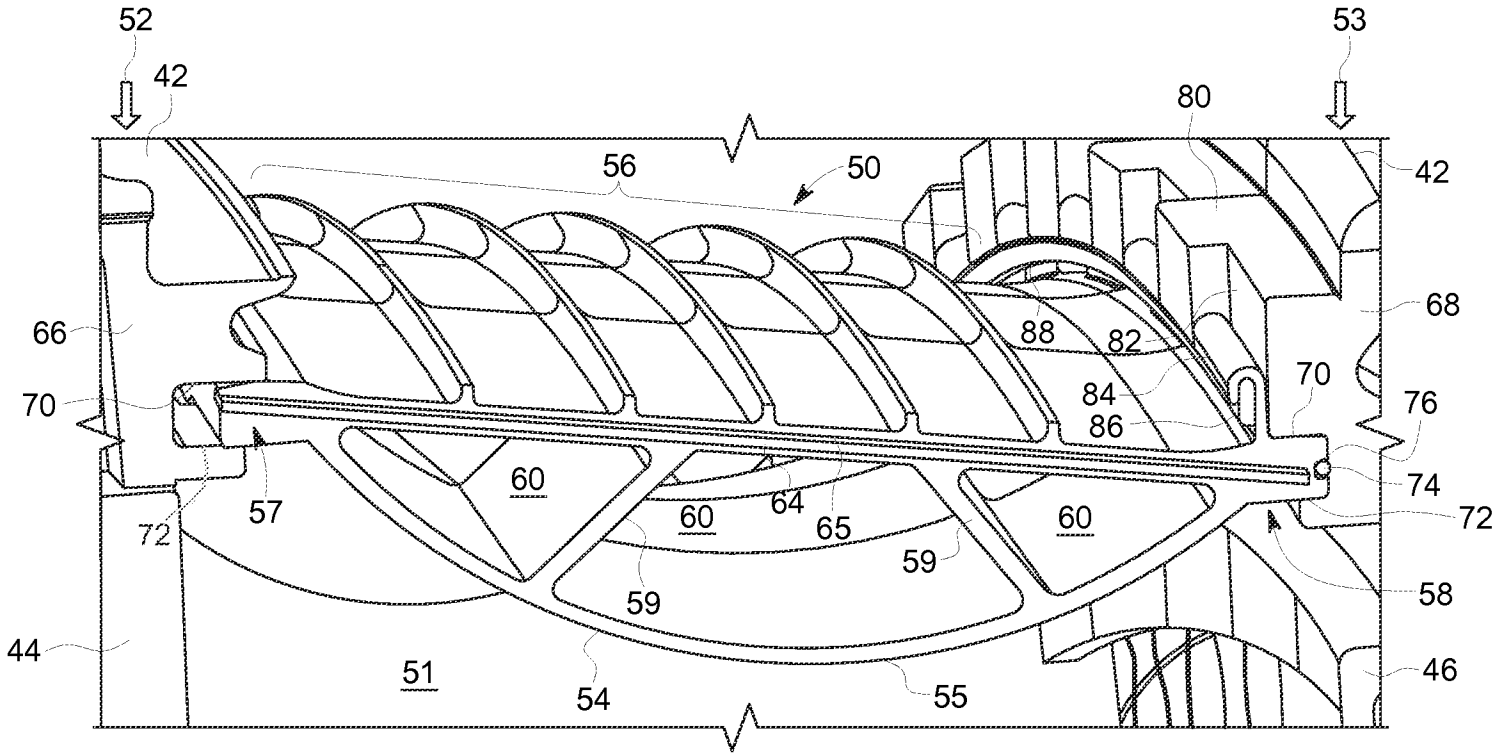
FIG. 3 is a partial perspective view of an interstage sealing system of a multi-stage turbine, in accordance with one or more embodiments shown or described herein.
Figure 4:
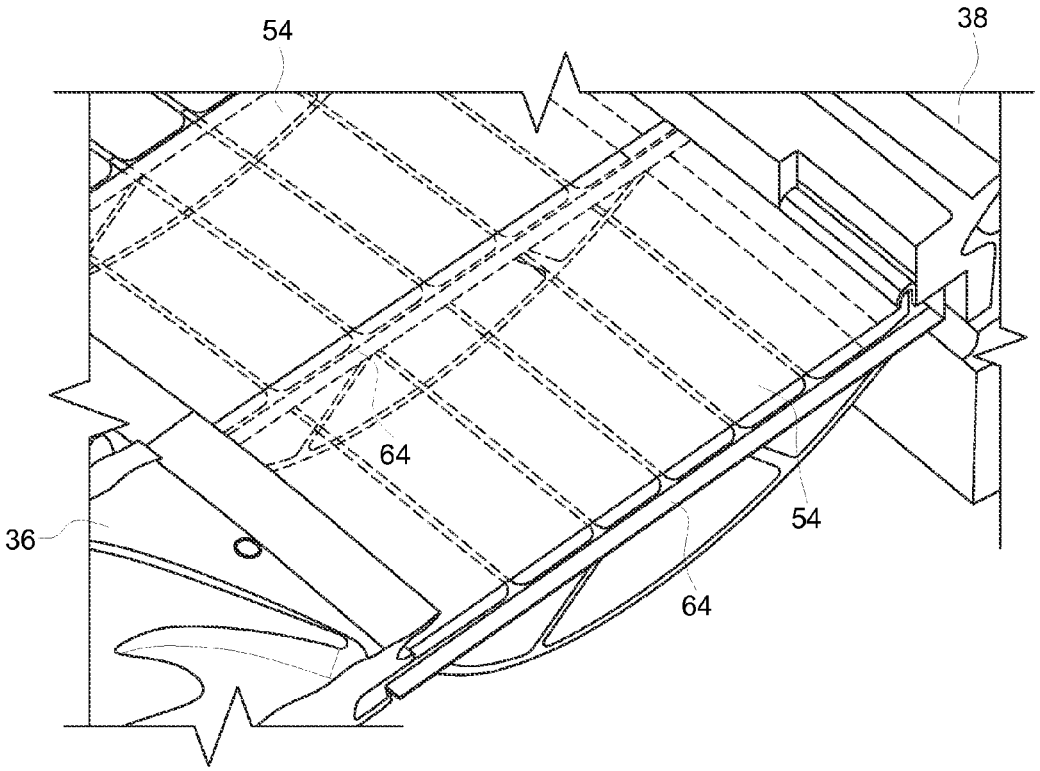
FIG. 4 is a partial perspective view of the interstage sealing system of FIG. 3, in accordance with one or more embodiments shown or described herein.

FIGS. 3 and 4 are partial perspective views of the single interstage sealing system 50 of the multi-stage turbine 12 (as shown in FIG. 1), in accordance with one or more embodiments shown or described herein. The interstage sealing system 50 is comprised of a plurality of near flow path interstage seal segments 54 (as best illustrated in FIG. 4) disposed circumferentially about the turbine rotor wheel shaft 26 (as shown in FIG. 1), of the multi-stage turbine engine 12 (as shown in FIG. 1). As illustrated, the interstage sealing system 50 extends axially between a forward turbine stage 52, such as the first turbine stage 36, and more particularly the forward stage buckets 42, and an aft turbine stage 53, such as the aft turbine stage 38, and more particularly the aft stage buckets 42, of the multi-stage turbine 12 (as shown in FIG. 1). Each of the near flow path interstage seal segments 54 is typically a single, uniform structure shaped similar to a tied-arch bridge and configured to handle centrifugal forces associated with operation of the gas turbine engine 12.

As best illustrated in FIG. 3, an optimal geometry of the near flow path seal segment 54 includes a curved bottom portion 55 and a horizontal relatively planar portion 56, defining a forward end portion 57 and an aft end portion 58. The seal segment 54 further includes a main body portion 62 extending axially from the forward end portion 57 to the aft end portion 58. The main body portion 62 comprising at least two support webs 59 coupling the forward end portion 57 to the aft end portion 58, and the relatively planar portion 58 and the curved bottom portion 56. The at least two support webs 59 form a plurality of hollow portion s 60. The plurality of hollow portions 60 reduces the overall weight and material cost of the interstage sealing system 50. In other embodiments, such as those described herein, the optimal geometry may vary depending upon the application. The interstage sealing system 50 further comprises a plurality of intersegment spline seals 64 disposed axially between the near flow path seal segments 54 and within a plurality of spline seal slots 65 formed in each of the near flow path seal segments 54 to provide intersegment gap sealing therebetween.

In an embodiment, a lower portion of the buckets 42, and more particularly a forward stage bucket shank 66 and an aft stage bucket shank 68 may be configured to provide retention of the near flow path seal segments 54. As best illustrated in FIG. 3, a support land 70 and a support land 72 are provided in an angel wing region of the forward stage bucket shank 66 and a support land 70 and a support land 72 are provided in an angel wing region of the aft stage bucket shank 68. The interstage sealing system 50 further includes a seal wire 74 disposed in a seal wire groove 76 of the near flow path seal segment 54 and located axially between the near flow path seal segment 54 and the aft stage bucket shank 68 for isolating the forward turbine rotor wheel 44 and the aft turbine rotor wheel 46 from the flow of hot gas path 14 (as shown in FIG. 1).

Figure 5:
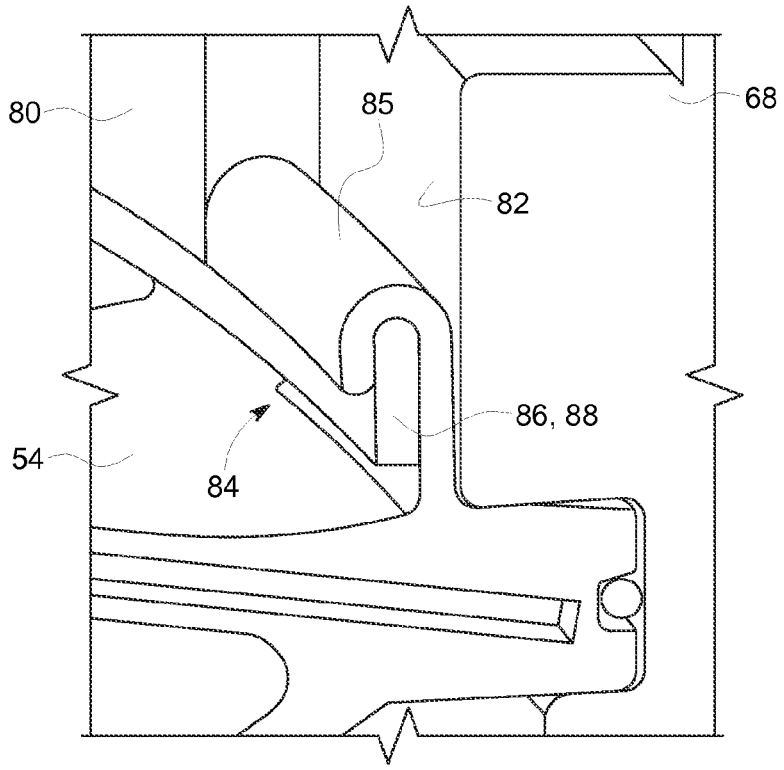
FIG. 5 is a partial perspective view illustrating a portion of the interstage sealing system of FIG. 3, in accordance with one or more embodiments shown or described herein.

Further, as shown, the aft stage bucket shank 68 includes a plurality of L-shaped seats 80. Each of the plurality of L-shaped seats 80 includes a landing face 82 that is completely engaged with the near flow path seal segments 54 when mounted. As best illustrated in an enlarged view in FIG. 5, each of the near flow path seal segments 54 includes a plurality of cooperating retention features 84, such as a plurality of scalloped hooks 85, that when mounted in combination with a capture means 86 enables radial and circumferential retention of the near flow path seal segments 54. In an embodiment, the capture means 86 may include a retention ring 88, such as illustrated in FIG. 5. In alternate embodiments, the capture means 86 may include a lock wire, one or more fasteners, or the like.

It is to be noted that in each of the embodiments disclosed herein, the plurality of near flow path seal segments 54 comprising a portion of the interstage sealing system 50 may be less in number as compared to buckets disposed on either a forward stage or an aft stage of the multi-stage turbine 12 (as shown in FIG. 1). In one embodiment, the interstage sealing system 50 includes a wear resistant coating, on all contact surfaces between the forward stage bucket shank 66, the aft stage bucket shank 68 and the near flow path seal segment 54 for mitigating wear. The interstage sealing system 50 may also include a plurality of additional interstage sealing systems, such as an aft interstage sealing systems (not shown) and a plurality of third interstage sealing systems (not shown) extending axially between the aft turbine stage and a third turbine stage (not shown) of the multi-stage turbine land between the third turbine stage and a fourth turbine stage respectively.

Figure 6:
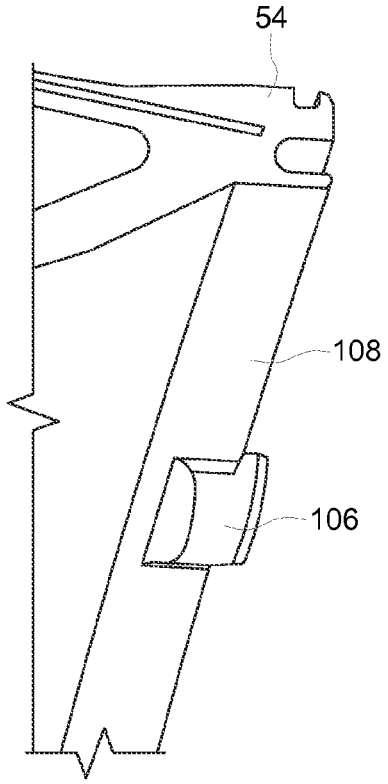
FIG. 6 is a partial perspective view illustrating a portion of an interstage sealing system, in accordance with one or more embodiments shown or described herein.
Figure 7:
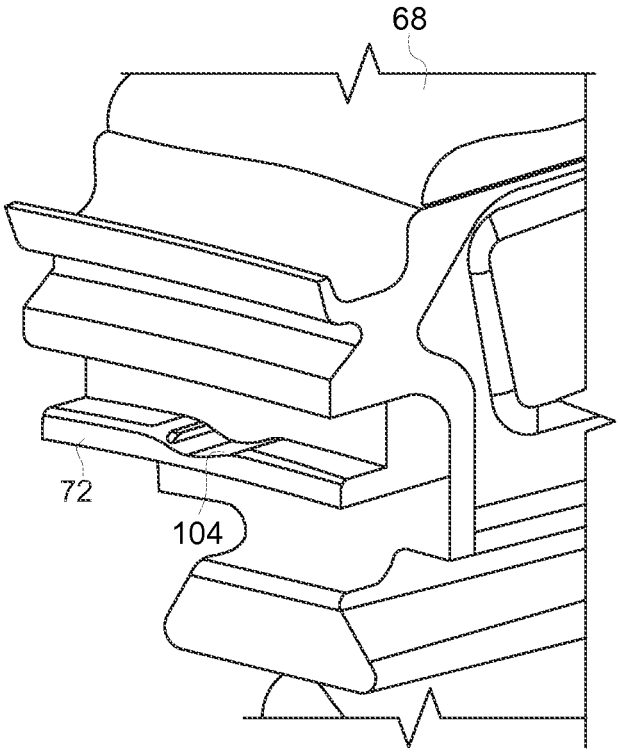
FIG. 7 is a partial perspective view illustrating a portion of the interstage sealing system of FIG. 6, in accordance with one or more embodiments shown or described herein.

FIGS. 6 and 7 are perspective views of a sealing system having the interstage sealing system 50, in accordance with one or more embodiments shown or described herein. As illustrated in FIG. 7, the receiving structure, and more particularly the support land 72 formed in the aft stage bucket shaft 68, may include a plurality of recessed roundcuts 104 that allows for locking with a plurality of protruding tabs 106 located underside of the near flow path seal segment 54 on a lower aft side 108 (FIG. 6) for circumferentially constraining the near flow path seal segment 54. In an alternate embodiment, a plurality of protruding tabs may be located on a topside of the near flow path seal segment 54 so as to engage with a plurality of cooperatively formed recessed roundcuts.

Figure 8:
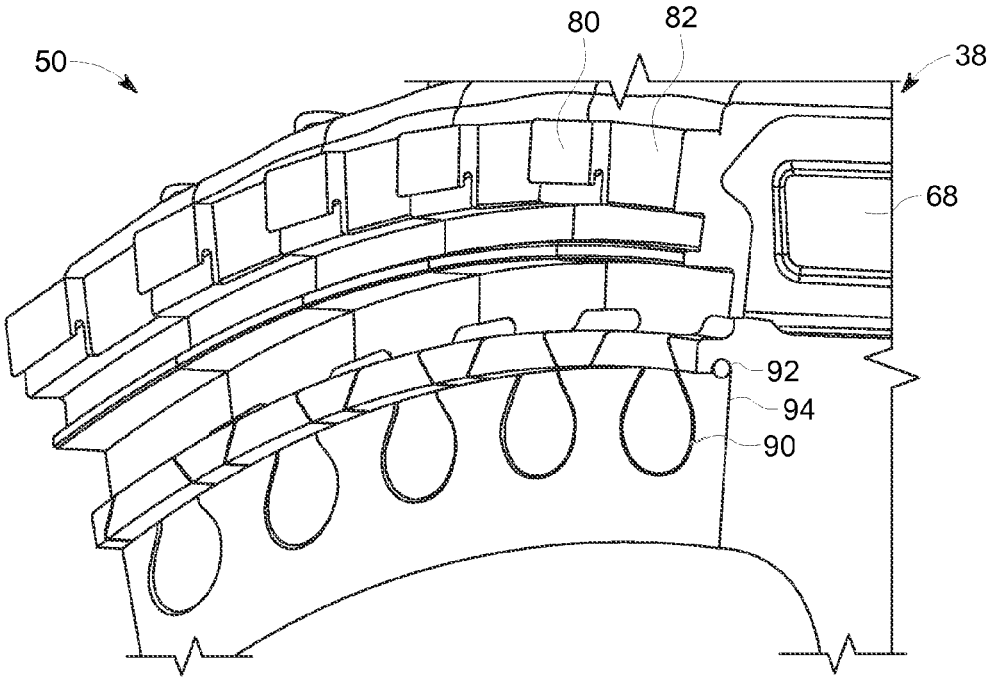
FIG. 8 is a partial perspective view of an aft turbine stage of the multi-stage turbine illustrating a step in a method of assembling a sealing system of a multi-stage turbine, in accordance with one or more embodiments shown or described herein.

Referring now to FIGS. 8-15, illustrated are steps in a method of assembling the interstage sealing system 50 of FIGS. 3 and 4. FIG. 8 is a perspective view of a portion of the aft stage bucket shank 68 of the interstage sealing system 50 and a portion of the aft turbine rotor wheel 46, in accordance with one or more embodiments shown or described herein. As shown, the aft stage bucket shank 68 includes the plurality of L-shaped seats 80 and the plurality of landing faces 82 at the inner end for enabling radial and circumferential retention of the near flow path seal segments 54 (as shown in FIG. 3) when mounted on the aft bucket shank. As shown, each of the of L-shaped seats 80 spans to one dovetail slot width circumferentially and is spaced apart by one dovetail slot width. In other embodiments, the span may be a fraction of one dovetail width or a plurality of dovetail widths. The method includes installing each of the multiple aft stage buckets 42, via the bucket shank 68, onto each of a plurality of dovetail slots 90 of the aft turbine rotor wheel 46. In an embodiment, each of the multiple aft stage buckets 42 is disposed relative to the dovetail slot 90 so as to provide flush engagement on a forward inner side of the aft turbine rotor wheel 46. In an alternate embodiment, about one-fifth of a dovetail axial width of each of the plurality of aft stage bucket shanks 68 is extended axially towards a forward side (described presently). In yet other embodiments, a span of the dovetail axial width of each of the plurality of aft stage bucket shanks 68 which extend axially towards a forward side may vary. A lockwire 92 may be positioned within a lockwire groove 94 formed in the aft turbine rotor wheel 46 to provide locking of each of the aft stage bucket shanks 68 to the aft stage turbine rotor wheel 46.

Figure 9:
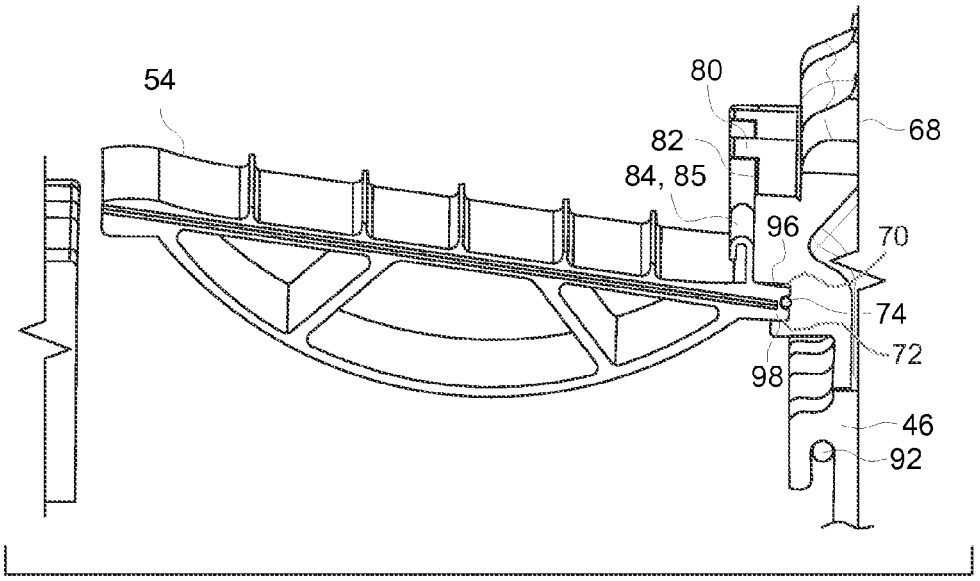
FIG. 9 is a partial perspective view illustrating a step in a method of assembling a sealing system of a multi-stage turbine, in accordance with one or more embodiments shown or described herein.

FIG. 9 is a perspective view of a single near flow path seal segment 54 during positioning relative to the aft stage bucket shank 68. The method includes mounting the near flow path seal segment 54 on the aft stage bucket shank 68 by moving the near flow path seal segment 54 radially inward toward the turbine shaft (not shown) and then axially toward the aft stage bucket shank 68, such that an outer seal surface 96 of the single near flow path seal segment 54 is engaged with the support land 70 and an inner support face 98 of the single near flow path seal segment 54 is engaged with a support land 72 of the aft stage bucket shank 68. In addition, during positioning, the cooperating retention features 84, and more particularly the plurality of scalloped hooks 85, of the near flow path seal segment 54 are positioned to fully engage with the plurality of L-shaped seats 80 and the plurality of landing faces 82 of the aft stage bucket shank 68. Prior to mounting the near flow path seal segment 54, the method may include positioning the seal wire 74 in the seal groove 76 as previously described with regard to FIG. 3.

Figure 10:
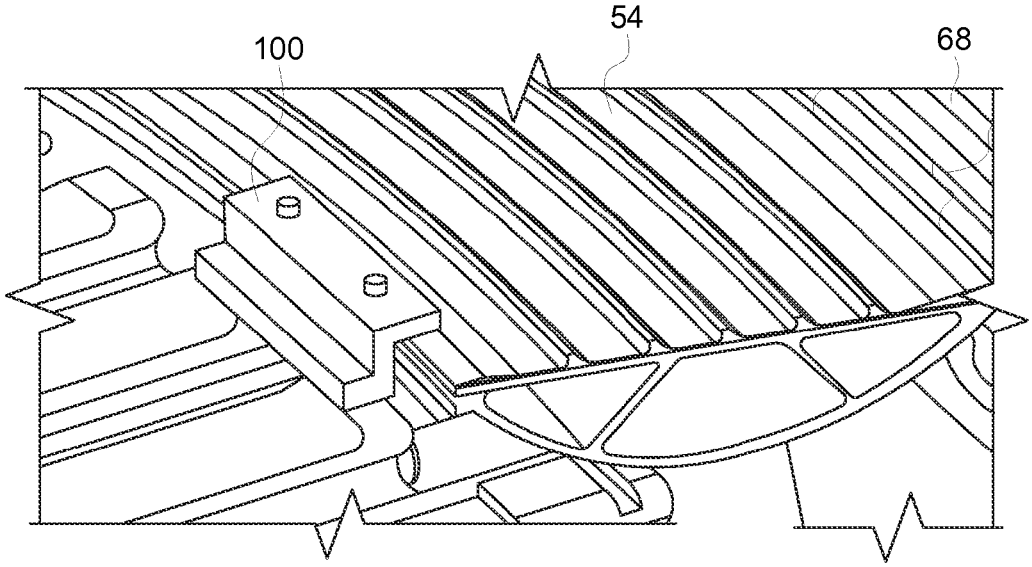
FIG. 10 is a partial perspective view illustrating a step in a method of assembling a sealing system of a multi-stage turbine, in accordance with one or more embodiments shown or described herein.
Figure 11:
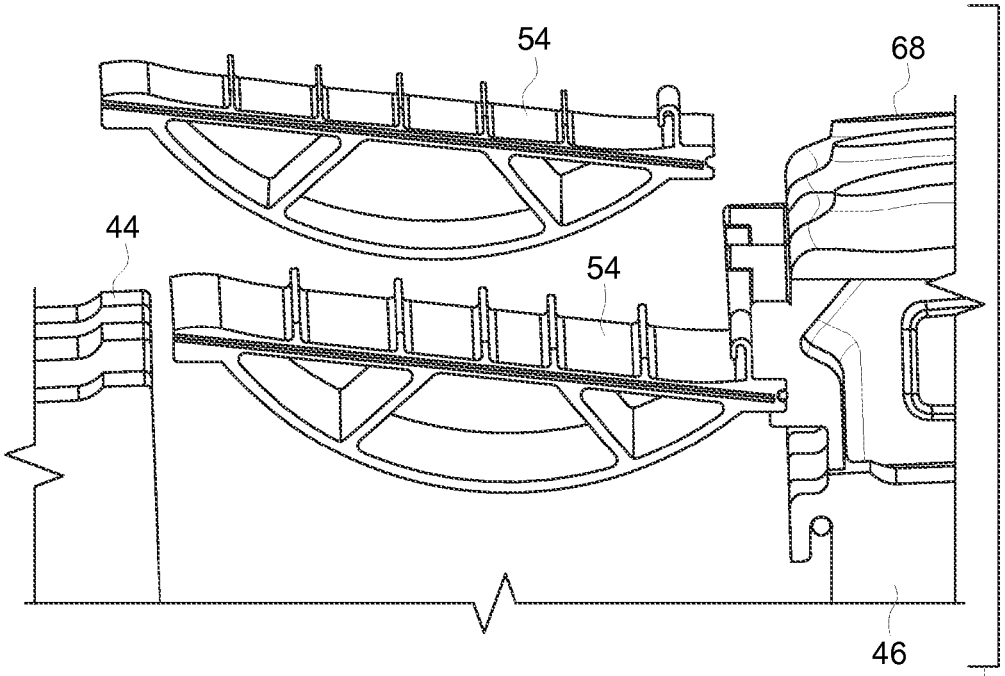
FIG. 11 is a partial perspective view illustrating a step in a method of assembling a sealing system of a multi-stage turbine, in accordance with one or more embodiments shown or described herein.
Figure 12:
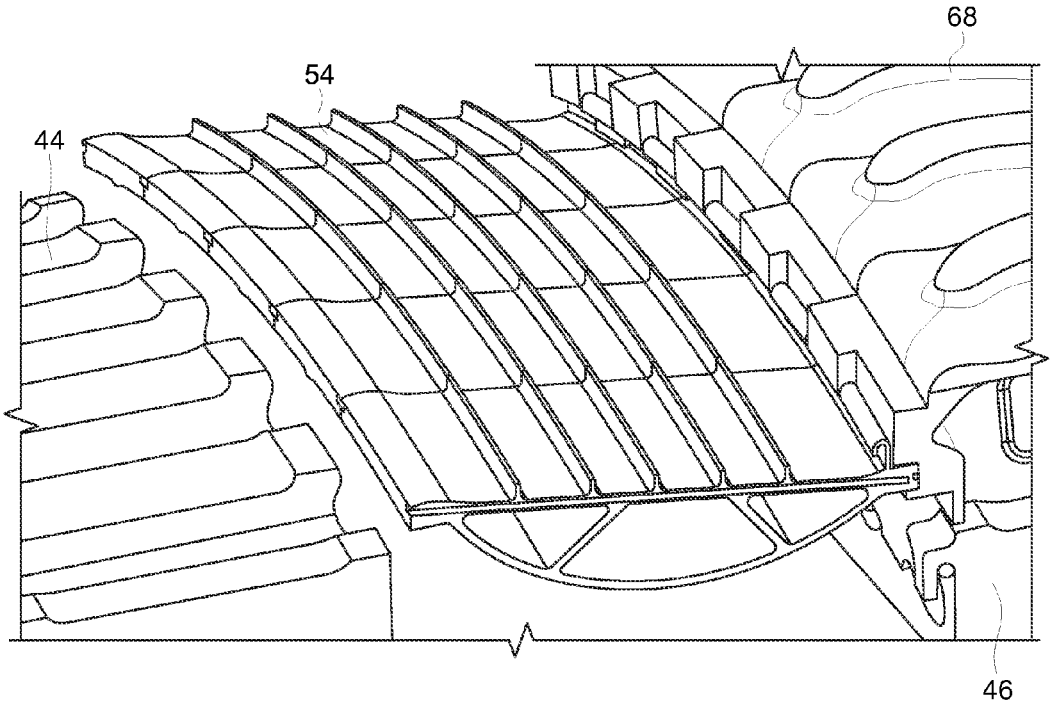
FIG. 12 is a partial perspective view illustrating a step in a method of assembling a sealing system of a multi-stage turbine, in accordance with one or more embodiments shown or described herein.

As best illustrated in FIG. 10, subsequent to positioning the aft end of the near flow path seal segment 54 relative to the aft stage bucket shank 68, a temporary positioning tool 100 may be utilized to hold the near flow path seal segment 54 in position. Next, the remaining near flow path seal segments 54 are positioned relative to the previously positioned near flow path seal segment 54 and the aft stage bucket shank 68, as best illustrated in FIGS. 11 and 12.

Figure 13:
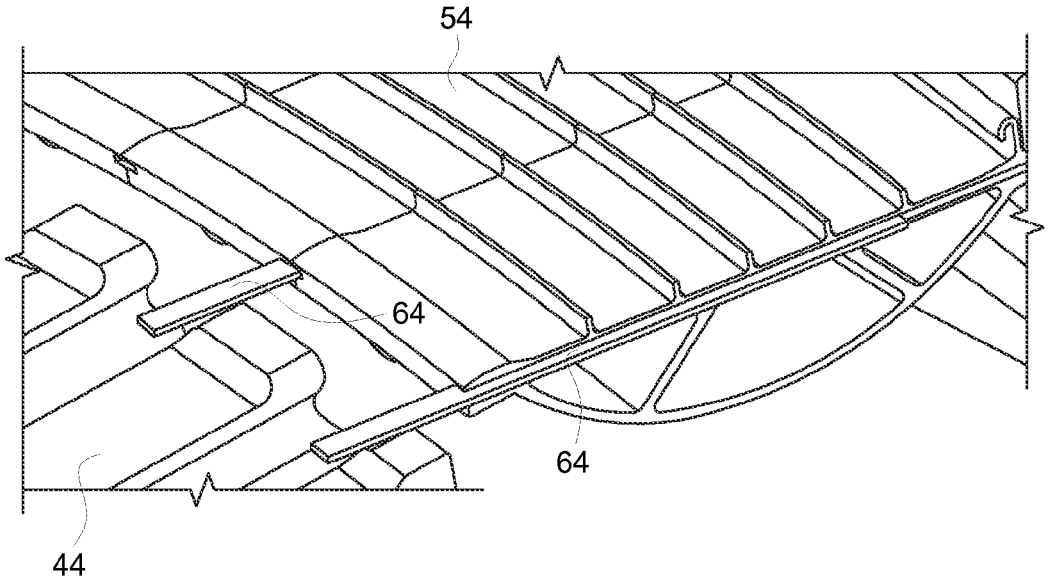
FIG. 13 is a partial perspective view illustrating a step in a method of assembling a sealing system of a multi-stage turbine, in accordance with one or more embodiments shown or described herein.
Figure 14:
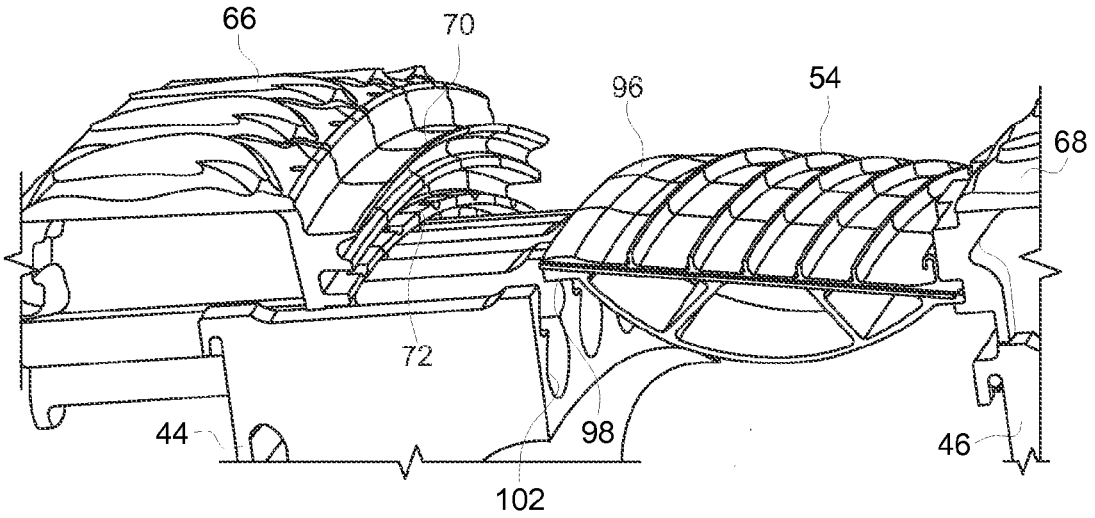
FIG. 14 is a partial perspective view illustrating a step in a method of assembling a sealing system of a multi-stage turbine, in accordance with one or more embodiments shown or described herein.
Figure 15:
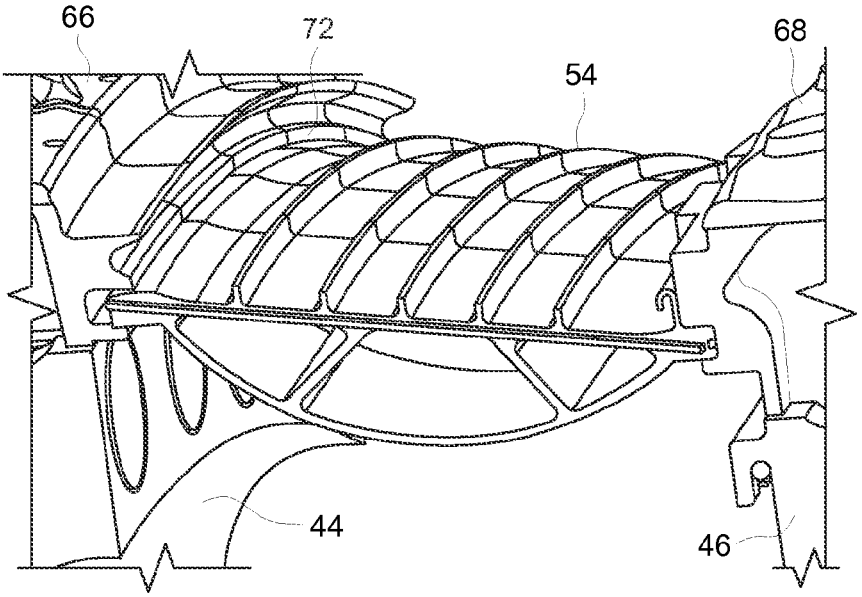
FIG. 15 is a partial perspective view illustrating a step in a method of assembling a sealing system of a multi-stage turbine, in accordance with one or more embodiments shown or described herein.

Referring now to FIG. 13, subsequent to positioning of the plurality of near flow path seal segments 54 relative to the aft stage bucket shanks 68, the plurality of intersegment spline seals 64 are disposed axially between the near flow path seal segments 54 to provide intersegment gap sealing therebetween. Finally, as illustrated in FIGS. 14 and 15 in a perspective view, the forward stage buckets, and more particularly the forward stage bucket shafts 66, are positioned relative to the near flow path seal segments 54 and the forward stage turbine rotor wheel 44. As shown, the forward stage turbine rotor wheel 44 includes multiple dovetail slots 102 configured for mounting the plurality of buckets 42, and more particularly the forward stage bucket shafts 66. As illustrated, the method includes moving the forward stage bucket shaft 66 axially toward the near flow path seal segment 54, such that the outer seal surface 96 at the forward end of the single near flow path seal segment 54 is engaged with the support land 70 and the inner support face 98 at the forward end of the single near flow path seal segment 54 is engaged with a support land 72 of the forward stage bucket shank 66. The capture ring 86, as previously described with reference to FIG. 5, is next positioned to lock the near flow path seal segments 54 to the aft stage bucket shaft 68. The procedure may be revered for disassembly of the interstage sealing system 50.

Figure 16:
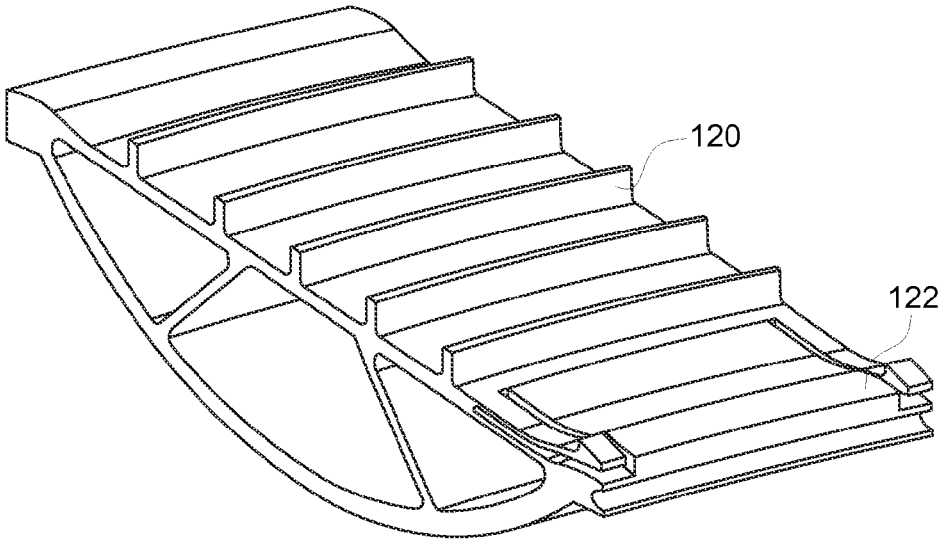
FIG. 16 is a partial perspective view of an alternate embodiment of a near flow path seal segment of a sealing system of a multi-stage turbine, in accordance with one or more embodiments shown or described herein.
Figure 17:
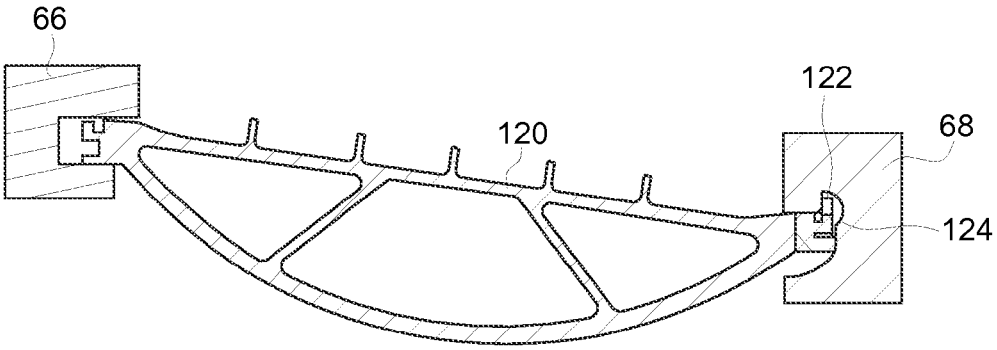
FIG. 17 is a partial sectional view of an interstage sealing system including the near flow path seal segment of FIG. 16, in accordance with one or more embodiments shown or described herein.

Referring now to FIGS. 16-19, illustrated are alternate configurations of a near flow path seal segment, generally similar to the near flow path seal segment 54 of FIGS. 1-15. Referring more specifically to FIGS. 16 and 17, illustrated is near flow path seal segment 120 including a clip joint 122. The clip joint 122 is configured to mate with a corresponding groove 124 cut into the aft stage bucket shank 68, thereby eliminating the need for a capture ring or other means for deterministic retention. As best illustrated in FIG. 17, in an embodiment the aft stage bucket shank 68 includes the groove 124, configured for retention therein of the near flow path seal segment 120 to provide both axial and radial retention of the near flow path seal segment 120 relative to the aft stage bucket shank 68. The specially shaped groove 124 on the aft stage bucket shank 68 allows for the near flow path segment 120 to be rotated into place and achieve deterministic retention.

Figure 18:
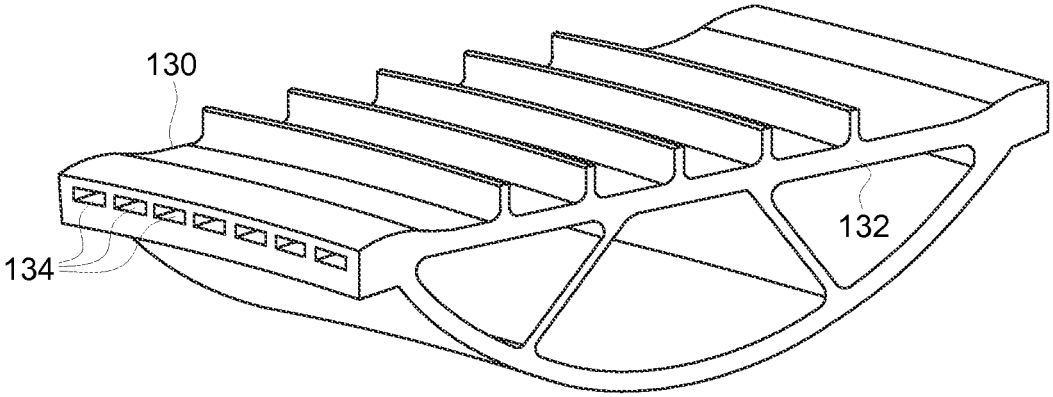
FIG. 18 is a partial perspective view of an alternate embodiment of a near flow path seal segment of a sealing system of a multi-stage turbine, in accordance with one or more embodiments shown or described herein.
Figure 19:
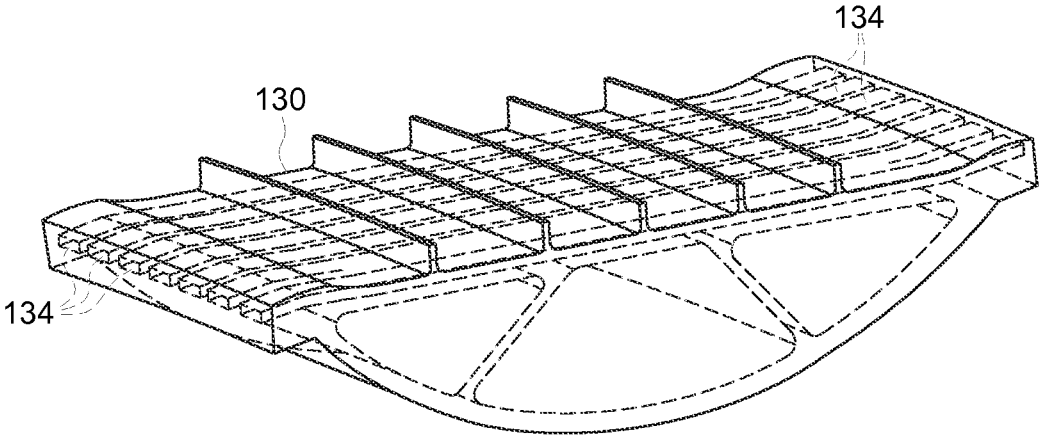
FIG. 19 is a partial phantom perspective view of the near flow path seal segment of FIG. 18, in accordance with one or more embodiments shown or described herein.

In an alternate embodiment, as best illustrated in FIGS. 18 and 19, a near flow path seal segment 130 includes a thickened intersegment seal ligament 132 that is accomplished without changing the seal segment mass. More particularly, as illustrated in FIGS. 18 and 19, the near flow path seal segment 130 includes a plurality of through-passages 134 that provide for an offset in mass for the added thickened intersegment seal ligament 132. This near flow path seal segment 130 provides sufficient real-estate for intersegment spline seals (not shown), such as the plurality of spline seals 64 (as shown in FIG. 4). In keeping with the use of intersegment spline seals, a plurality of seal slots (not shown), such as the spline seal slots 65 (as shown in FIG. 3), may include rounded portions, thereby reducing the effect of stress concentrations within the near flow path seal segment 130.

Figure 20:
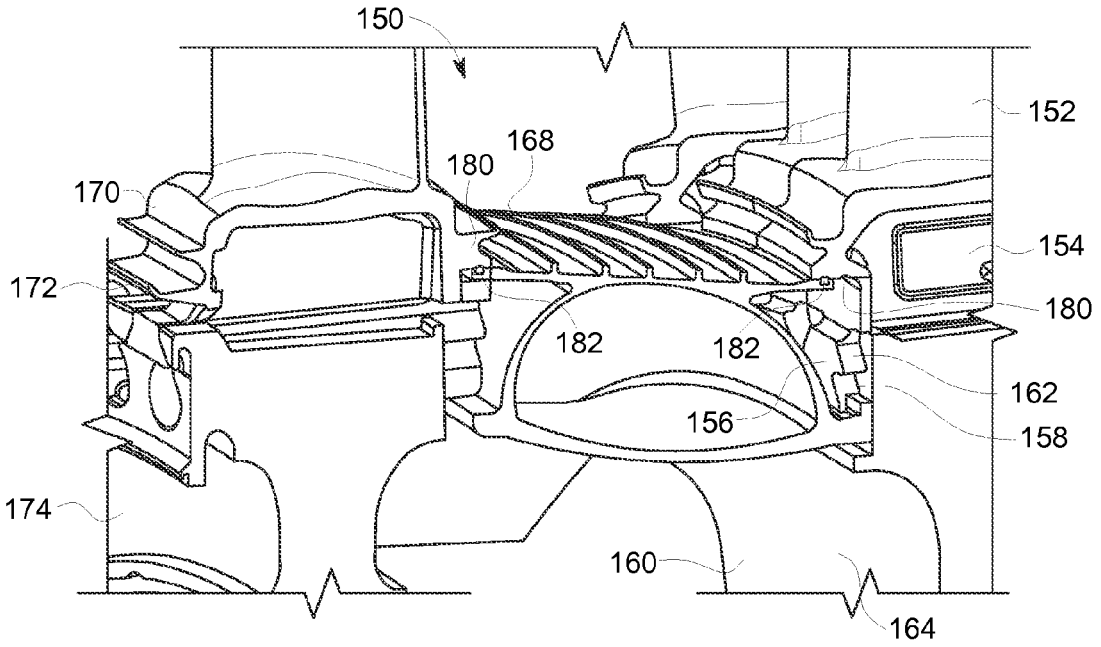
FIG. 20 is a partial perspective view of an alternate embodiment of an interstage sealing system of a multi-stage turbine, in accordance with one or more embodiments shown or described herein.
Figure 21:
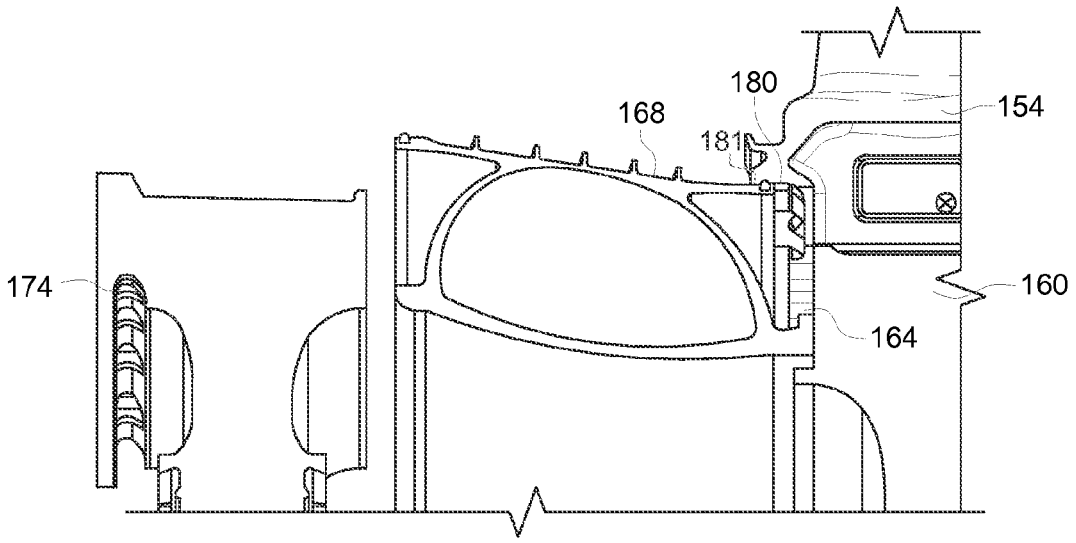
FIG. 21 is a partial perspective view illustrating a step in a method of assembling the interstage sealing system of FIG. 20, in accordance with one or more embodiments shown or described herein.

Referring now to FIGS. 20-23, illustrated are alternate configurations of an interstage sealing system 150 disclosed herein. As previously indicated with respect to FIG. 8, in an embodiment, a portion of a dovetail axial width of each of the plurality of aft bucket shanks may be extended axially towards a forward side. As best illustrated in FIG. 20, in this particular embodiment of the interstage sealing system 150, each of a plurality of aft stage buckets 152, includes an aft stage bucket shank 154, generally similar to aft stage bucket shank 68 of FIGS. 1-19. Each of the aft stage bucket shanks 154 includes a plurality of dovetails 156. During assembly, each of a plurality of aft stage buckets 152 are installed via the bucket shanks 154, onto each of a plurality of dovetail slots 158 of an aft stage turbine rotor wheel 160. A portion 162 of a dovetail axial width of each of the plurality of aft stage bucket dovetails 156 is extended axially towards a forward side 164 of the aft stage turbine rotor wheel 160. In an embodiment, approximately one-fifth of the dovetail axial width is extended axially towards the forward side 164 of the aft stage turbine rotor wheel 160. In alternate embodiments, a portion of the span of the dovetail axial width of each of the plurality of aft stage bucket shanks 154 which extends axially towards the forward side 164 may vary. The axially extending portions 162 of the dovetails 156 provide support and radial constrainment of a plurality of near flow path seal segments 168, as best illustrated in FIG. 21.

Referring again to FIG. 20, further illustrated are a plurality of forward stage buckets 170 (of which only one is illustrated), each including a forward stage bucket shank 172, and a forward stage turbine rotor wheel 174. Generally similar to the previously described embodiments, the bucket shanks 154, 172 of each of the plurality of forward and aft stage buckets 152, 170, respectively, are configured to provide retention of the near flow path seal segments 168. As best illustrated in FIG. 20, a support land 180 is provided in an angel wing region of the forward stage bucket shank 172 and a support land 180 is provided in angel wing region of the aft stage bucket shank 154. The interstage sealing system 150 further includes a plurality of seal ropes 182, each disposed in a seal groove 184 formed in the near flow path seal segment 168 and located axially between the near flow path seal segment 168 and the forward stage bucket shank 172 and between the near flow path seal segment 168 and the aft stage bucket shank 154 for isolating the forward and aft stage turbine rotor wheels 174, 160 from the flow of the hot gas path 14 (as shown in FIG. 1). It is to be noted, this particular embodiment allows for a majority of the load transfer to occur through the axially extending portions 162 of the dovetails 156, enabling greater flexibility in the design of the bucket angel wing regions and support lands 180.

As in the previously described embodiments, it is to be noted in this particular embodiment the plurality of near flow path seal segments 168 comprising a portion of the interstage sealing system 150 may be less in number as compared to the buckets disposed on either the forward stage or the aft stage of the multi-stage turbine 12 (as shown in FIG. 1). The interstage sealing system 150 further includes a wear resistant coating on all contact surfaces between the forward stage bucket shank 172, the aft stage bucket shank 154 and the near flow path seal segment 168 for mitigating wear. The interstage sealing system 150 may also include additional interstage sealing systems (not shown) extending axially between additional stages (not shown) of the multi-stage turbine.

Figure 22:
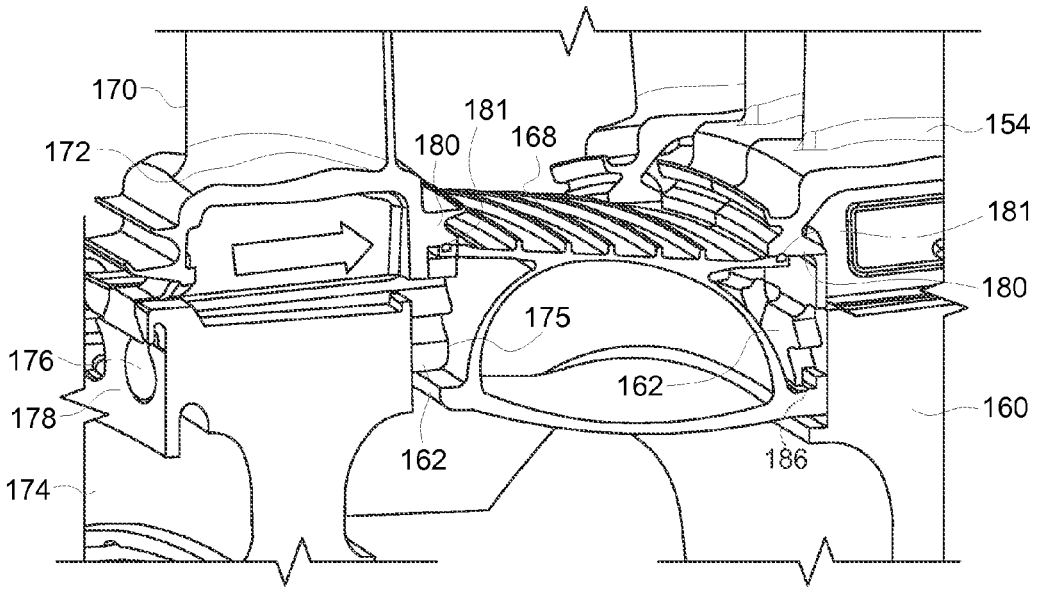
FIG. 22 is a partial perspective view illustrating a step in a method of assembling the interstage sealing system of FIG. 20, in accordance with one or more embodiments shown or described herein.

Referring specifically to FIGS. 21 and 22, illustrated are steps in a method of assembling the interstage sealing system 150 of FIG. 20. FIG. 21 is a sectional view and FIG. 22 is a perspective view, illustrating the near flow path seal segment 168, a portion of the aft stage bucket shank 154, a portion of the aft stage turbine rotor wheel 160 and a portion of the forward stage turbine rotor wheel 174 of the interstage sealing system 150, in accordance with one or more embodiments shown or described herein. As shown, the aft stage bucket shank 154 includes the plurality of axially extending portions 162 of the dovetails 156 and the plurality of support lands 180 on the inner diameter 164 of the aft stage turbine rotor wheel 160 extending in a general axial direction for enabling radial and circumferential retention of the near flow path seal segments 168 when mounted on the aft stage bucket shank 154. As shown mid-assembly in FIG. 21, the method includes installing each of the multiple aft stage buckets 152, via the aft stage bucket shanks 154, onto each of a plurality of dovetail slots 158 of the aft stage turbine rotor wheel 160. The method includes mounting the near flow path seal segment 168 on the aft stage bucket shank 154 by moving the near flow path seal segment 168 radially inward toward the turbine shaft (not shown) and then axially toward the aft stage bucket shank 154, such that an outer seal surface 181 of the single near flow path seal segment 168 is engaged with the support land 180 and an inner support face 186 is fully engaged with the extended portions 162 of the dovetails 156. Prior to mounting the near flow path seal segment 168, the method may include positioning the seal rope 182 in the near flow path seal segment 168 as previously described.

Referring now to FIG. 22, subsequent to positioning of the plurality of near flow path seal segments 168 relative to the aft stage bucket shanks 154, a plurality of intersegment spline seals (not shown), generally similar to the intersegment spline seals 64 (as shown in FIG. 4) are disposed axially between the near flow path seal segments 168 to provide intersegment gap sealing there between. As illustrated in FIG. 22, the forward stage buckets 170, and more particularly the forward stage bucket shafts 172, including a plurality of dovetails 176, are next positioned relative to the near flow path seal segments 168 and the forward stage turbine rotor wheel 174. As shown, the forward stage turbine rotor wheel 174 includes multiple dovetail slots 178 configured for mounting the plurality of forward stage buckets 170, and more particularly for receiving the dovetails 176. As illustrated, the method includes moving each of the forward stage bucket shanks 172 axially toward the near flow path seal segments 168 such that the outer seal surfaces 181 of the near flow path seal segments 168 are engaged with the support land 180 of the forward stage bucket shank 172. The dovetails 176, as previously described with regard to the aft stage bucket shank 154, may be configured to extend axially so as to provide support and radial constrainment of the plurality of near flow path seal segments 168, and more particularly the inners support face 186. The procedure may be reversed for disassembly of the interstage sealing system 50.

Figure 23:
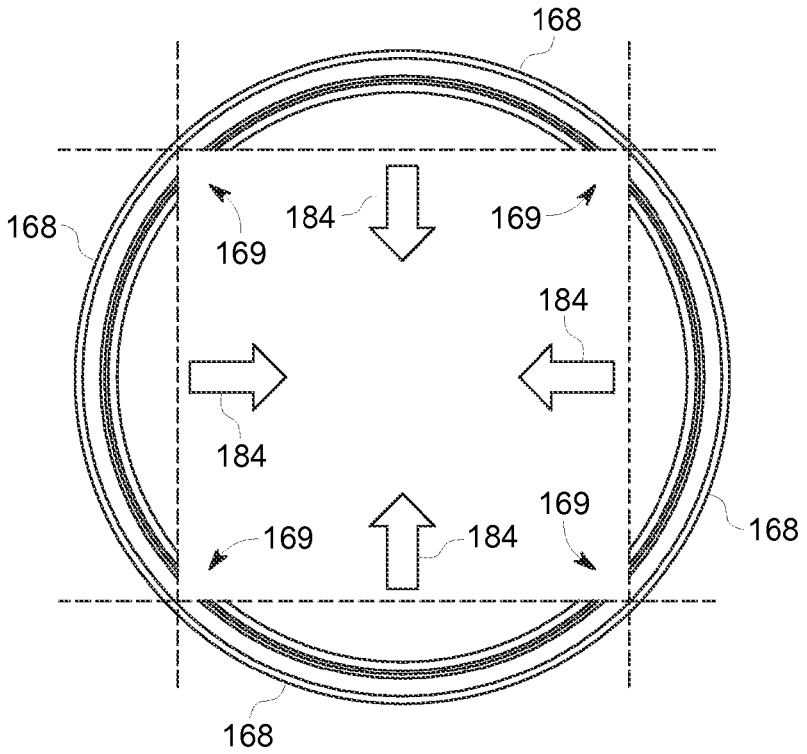
FIG. 23 is a simplified schematic view of the near flow path seal segments of the sealing system of FIG. 20, illustrating cut portions to facilitate radial inward movement, in accordance with one or more embodiments shown or described.

As illustrated in FIG. 23, in a simplified cross-sectional view, the interstage sealing system 150, and more particularly each of the plurality of near flow path seal segments 168 may include cut portions 169 so as to provide for radial inward movement, as indicated by directional arrows 184, of the plurality of near flow path seal segments 168.

Referring now to FIGS. 24-26, illustrated are alternate configurations of an interstage sealing system 200 disclosed herein. In contrast to the previously disclosed embodiments, the interstage sealing system 200, and more particularly a plurality of near flow path seal segments 202, are radially and axially constrained on a dovetail portion of the forward stage buckets. As best illustrated in FIGS. 24-26, in this particular embodiment of the interstage sealing system 200, each of a plurality of aft stage buckets 204 include an aft stage bucket shank 206, generally similar to aft stage bucket shank 68 of FIGS. 1-19, including a plurality of dovetails (not shown). During assembly, each of a plurality of aft stage buckets 204 are installed via the bucket shank 206, onto each of a plurality of dovetail slots (not shown) of an aft stage turbine rotor wheel 208.

FIG. 24 further illustrates a plurality of forward stage buckets 210 each including a forward stage bucket shank 212, and a forward turbine rotor wheel 214. Generally similar to the previously described embodiments, the bucket shank 212, 206 and dovetail portion of each of the plurality of forward and aft stage buckets 210, 204, respectively, are configured to provide retention of the near flow path seal segments 202. In contrast to the previously disclosed embodiments, radial and axial constrainment of the near flow path seal segments 202 is accomplished on the forward stage. In addition, special angular end cuts are not required (as previously described with regard to FIG. 23) for assembly. As best illustrated in FIG. 24, a support land 216 is provided in an angel wing region of the forward stage bucket shank 212 and a support land 216 is provided in an angel wing region of the aft stage bucket shank 206. The interstage sealing system 200 further includes a retaining feature 218 formed in the aft stage turbine rotor wheel 208 for the retainment therein of the near flow path seal segments 202. In the illustrated embodiment, the retaining feature 218 is in the form of a slot formed into the aft stage turbine rotor wheel 208. The interstage sealing system 200 further includes a retaining feature 226 formed in the forward stage turbine rotor wheel 214 for the retainment therein of the near flow path seal segments 202. In the illustrated embodiment, the retaining feature 226 is in the form of an axially extending tang 226 formed on the forward stage turbine rotor wheel 214 so as to provide additional radial and circumferential constrainment of the near flow path seal segments 202 when the near flow path seal segments 202 are engaged therewith.

As in the previously described embodiments, it is to be noted in this particular embodiment the plurality of near flow path seal segments 202 comprising a portion of the interstage sealing system 200 may be less in number as compared to buckets disposed on either a forward stage or an aft stage of the multi-stage turbine 12 (as shown in FIG. 1). The interstage sealing system 200 further includes a wear resistant coating 220 on all contact surfaces of the forward and aft stage bucket shanks 212, 206, the forward and aft stage turbine rotor wheels 214, 208 and the near flow path seal segment 202 for mitigating wear. The interstage sealing system 200 may also include additional interstage sealing systems (not shown) extending axially between additional turbine stages (not shown) of the multi-stage turbine.

Referring specifically to FIGS. 25 and 26, illustrated are steps in a method of assembling the interstage sealing system 200 of FIG. 24. FIG. 25 is a perspective view illustrating the near flow path seal segment 202, a portion of the aft stage bucket shank 206, a portion of the aft stage turbine rotor wheel 208 and a portion of the forward stage turbine wheel 214 of the interstage sealing system 200, in accordance with one or more embodiments shown or described herein. The aft stage turbine rotor wheel 208 includes the retaining feature 218 for enabling radial retention of the near flow path seal segments 202. As shown mid-assembly in FIG. 25, the method includes installing each of the plurality of aft stage buckets 204, via the aft stage bucket shanks 206, onto each of a plurality of dovetail slots of the aft stage turbine rotor wheel 208. The method includes mounting the near flow path seal segment 202 on the aft stage bucket shank 206 and the aft stage turbine rotor wheel 208 by moving the near flow path seal segment 202 radially inward toward the turbine shaft (not shown) and then axially toward the aft stage bucket shank 206 and the aft stage turbine rotor wheel 208, such that an outer seal surface 222 of the single near flow path seal segment 202 is engaged with the support land 216 formed in the aft stage bucket shank 206 and an inner support face 224 is engaged with the retaining feature 218 formed in the aft stage turbine rotor wheel 208 and the axially extending tang 216 formed on the forward stage turbine rotor wheel 214. Prior to mounting the near flow path seal segment 202, the method may include positioning a seal rope, a seal wire, or the like, relative to the near flow path seal segment 202, as previously described.

Referring now to FIG. 26, subsequent to positioning of the plurality of near flow path seal segment 202 relative to the aft stage bucket shank 206, the aft stage turbine rotor wheel 208 and the forward stage turbine rotor wheel 214, a plurality of intersegment spline seals (not shown), generally similar to the intersegment spline seals 64 (as shown in FIG. 4) are disposed axially between the near flow path seal segments 202 to provide intersegment gap sealing therebetween. As illustrated in FIG. 26 in a perspective view, the forward stage buckets 210, and more particularly the forward stage bucket shanks 212, including a plurality of dovetails, are next positioned relative to the near flow path seal segments 202 and the forward stage turbine rotor wheel 214. As shown, the forward stage turbine rotor wheel 214 includes multiple dovetail slots configured for mounting the plurality of buckets 210, and more particularly for receiving the dovetails. As illustrated, the method includes moving the forward stage bucket shank 212 axially toward the near flow path seal segments 202 such that the outer seal surfaces 222 of the near flow path seal segments 202 are engaged with the support land 216 of the forward stage bucket shank 212. The procedure may be reversed for disassembly of the interstage sealing system 200.

FIG. 27 is flow chart 300 illustrating steps involved in a method of assembling a sealing system of a multi-stage turbine, in accordance with one or more embodiments shown or described herein. At step 302, the method includes installing each of the plurality of aft buckets onto each of a plurality of dovetail slots of the aft stage turbine rotor wheel. In one embodiment, the aft stage buckets, and more particularly the radially extending dovetails of the aft stage buckets, are positioned flush the dovetail slots on a forward side of the aft turbine rotor wheel. In other embodiments, a portion of a dovetail axial width of each of the plurality of aft stage buckets, and more particularly the radially extending dovetails, are positioned extending axially beyond the aft stage turbine rotor wheel towards a forward side.

At step 304, the method includes engaging an outer seal surface at an aft end of each of a plurality of interstage seal segments with a support land in an angel wing region of each of the plurality aft stage buckets. The step of engaging the outer seal surface with the support land includes engaging the outer seal surface by moving each of the plurality of interstage seal segments radially inward and then axially such that each of the plurality of interstage seal segments are fully engaged with the support land of the plurality of aft stage buckets. In an embodiment, each of the plurality of interstage seal segments may further engage with a plurality of retaining features. At step 306, the method includes engaging an inner support face at an aft end of each of the plurality of interstage seal segments with one of a support land in the angel wing region of each of the plurality of aft stage buckets, a dovetail region of the plurality of aft stage buckets or the aft turbine stage rotor wheel.

Further at step 308, the method includes installing each of the plurality of forward stage buckets onto each of a plurality of dovetail slots of the forward stage turbine rotor wheel to engage with the interstage seal segments. The method may further include disposing an aft axial retention ring between a plurality of tab protrusions on an inner diameter of the aft stage turbine rotor wheel and a plurality of cooperating retention features, such as scalloped hooks, on each of the plurality of interstage seal segments for locking each of the plurality of interstage seal segments with the aft stage turbine rotor wheel.

Advantageously, the present sealing system is reliable, robust seal for several locations in multi-stage turbines with high pressure drops and large transients. The interstage sealing systems are also economical to fabricate and lead to significant cost reduction stemming from spacer wheel material savings. Thus, the present interstage sealing system also enhances power density and reduces the secondary flows. The present interstage sealing system also allows for flange bolted rotor architecture, field replacement with only bucket stage removed, and flow path variability. The present interstage sealing system may also use reduced number of near flow path seal segments leading to fewer intersegment gaps and thereby lesser leakages. The interstage sealing system also ensures that substantially all the centrifugal load from the near flow path seal segments is transferred to the forward and aft turbine wheels. Further, the present interstage sealing system may eliminate the use of bucket dovetail seals and bucket shank seals.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A sealing system for a multi-stage turbine, the sealing system comprising:

an interstage seal disposed circumferentially about a turbine rotor wheel assembly of the multi-stage turbine and extending axially between a forward turbine stage and an aft turbine stage of the multi-stage turbine, wherein the interstage seal comprises:

a plurality of near flow path seal segments, wherein each of the plurality of near flow path seal segments comprises:

outer seal surfaces and inner support faces extending from at least one downstream region of the forward turbine stage to at least one upstream region of the aft turbine stage such that substantially all the centrifugal load from the interstage seal is transferred to a plurality of forward stage buckets and a plurality of aft stage buckets; and at least two support webs coupling the outer seal surfaces and the inner support faces, wherein each of the plurality of near flow path seal segments extends from an angel wing region of the plurality of forward stage buckets to an angel wing region of the plurality of aft stage buckets, the inner support faces extend from the angel wing region of the plurality of forward stage buckets to the angel wing region of the plurality of aft stage buckets, an aft portion of the interstage seal and the plurality of aft stage buckets comprise a plurality of cooperatively engaged retention features enabling at least one of radial and circumferential constraining of the interstage seal, the plurality of cooperatively engaged retention features comprise a plurality of recessed roundcuts that allow locking with a plurality of protruding tabs located on an aft portion of the interstage seal; and a forward stage turbine rotor wheel of the forward turbine stage and an aft stage turbine rotor wheel of the aft turbine stage, wherein the forward stage turbine rotor wheel comprises a plurality of dovetail slots configured for operatively coupling the plurality of forward stage buckets and the aft stage turbine rotor wheel comprises a plurality of dovetail slots configured for operatively coupling the plurality of aft stage buckets.

2. The system of claim 1, further comprising a plurality of intersegment spline seals located at both sides of each of the plurality of near flow path seal segments for preventing intersegment gap leakages.

3. The system of claim 1, wherein the outer seal surface at the angel wing region of the plurality of forward stage buckets is configured to be constrained in the radial direction by a support land of the plurality of forward stage buckets and wherein the outer seal surface at the angel wing region of the plurality of aft stage buckets is configured to be constrained in a radial direction by a land support of the plurality of aft stage buckets.

4. The system of claim 1, further comprising a seal wire or a seal rope disposed in a seal groove of the interstage seal and located one of axially and radially between the interstage seal and the plurality of aft stage buckets for isolating the aft turbine rotor wheel from a flow of hot gas path.

5. The system of claim 1, wherein the plurality of cooperatively engaged retention features comprise a plurality of scalloped hooks located on an aft portion of the interstage seal and a plurality of L-shaped seats and landing faces at the angel wing region of the aft stage bucket.

6. The system of claim 5, further comprising a capture means disposed between the plurality of L-shaped seats and landing faces at the angel wing region of the aft stage buckets and the plurality of scalloped hooks of the interstage seal for locking the interstage seal to the aft stage bucket.

7. The system of claim 6, wherein the capture means comprises one of a retention ring, a lock wire and one or more fasteners.

* * * * *